United States Patent [19]

Obermeyer et al.

[11] Patent Number: 4,780,024

[45] Date of Patent: Oct. 25, 1988

[54] CREST GATE

[76] Inventors: Henry K. Obermeyer, 36 Wickhams Fancy, Rivers Edge Rd., Collinsville, Conn. 06022; Charles E. Snow, P.O. Box 74, Newtonville, N.Y. 12128

[21] Appl. No.: 58,837

[22] Filed: Jun. 5, 1987

[51] Int. Cl.[4] ..... E02B 7/20

[52] U.S. Cl. ..... 405/115; 405/91

[58] Field of Search ..... 405/115, 91, 87, 90, 405/100, 101, 102, 108

[56] References Cited

U.S. PATENT DOCUMENTS 3,173,269 3/1965 Imbertson ..... 405/115 X

FOREIGN PATENT DOCUMENTS 0078711 6/1980 Japan ..... 405/115

0026108 2/1983 Japan ..... 405/115

0020812 2/1983 Japan ..... 405/115

*Primary Examiner*—Dennis L. Taylor

*Attorney, Agent, or Firm*—McCormick, Paulding & Huber

[57] ABSTRACT

A crest gate for a dam spillway has a plurality of pivotably mounted panels provided end-to-end across the spillway structure and each hinge joint is a flexible neoprene strip. Strips are also provided between adjacent panels for sealing the spaces between panels. These panels are raised by inflatable elongated tubular bladders secured to the spillway by a harness. The hinge strip and harness are secured in place by common clamping means.

9 Claims, 4 Drawing Sheets

CREST GATE

BACKGROUND OF THE INVENTION

This invention relates generally to crest gates for dam spillways and deals more particularly with a rigid gate pivotably provided at the top of the fixed spillway structure, which rigid gate is movable to a raised position by means of an inflatable bladder.

The provision of movable gates at the crest of a conventional dam spillway generally takes the form of an operating gate that may be either a rigid gate structure hydraulically raised or lowered to vary the height or head of the water, or in accordance with more recent technology, such a gate may take the form of an inflatable tube anchored at either end to a foundation so that the tube itself creates a head of water when filled with air or water and so that release of the air or water from the tube lowers the crest gate.

SUMMARY OF THE INVENTION

In its presently preferred form the crest gate is provided on a dam spillway and includes at least one generally rectangular rigid panel, means being provided for pivotably supporting the panel for movement between angularly spaced positions on an axis adjacent the spillway. The panel has a free end portion opposite the marginal pivoted edge which free end is movable vertically between raised and lowered positions, an elongated inflatable bladder of generally cylindrical cross-section is provided just downstream of the axis of pivotal movement of the panel. Harness means is provided for supporting the elongated bladder means and the harness is preferably tied into the anchor for the pivot structure. The pivot structure comprises an elongated strip of elastomeric material having one marginal edge secured to the spillway and having an opposite marginal edge secured to the rigid panel. The bladder means preferably has an inflated diameter D of approximately one-half to one-third the lateral expanse of the panel. This geometry assures a mechanical advantage for the inflatable bladder to permit raising of the panel to achieve a head or height of the water above the spillway that is greater than the cross sectional diameter of the bladder itself providing an advantage over the inflatable bladder type crest gate in that a smaller inflatable bladder can be provided to achieve a given vertical head height. The use of the bladder to raise the rigid panel provides a much improved mechanism for raising and lowering the rigid panel and the mounting for the marginal pivoted edge of the panel avoids the necessity for any hinge joint, such as provided in a hydraulically pivoted rigid panel configuration for example.

DETAILED DESCRITPTION OF PREFERRED EMBODIMENTS

Figure 1:
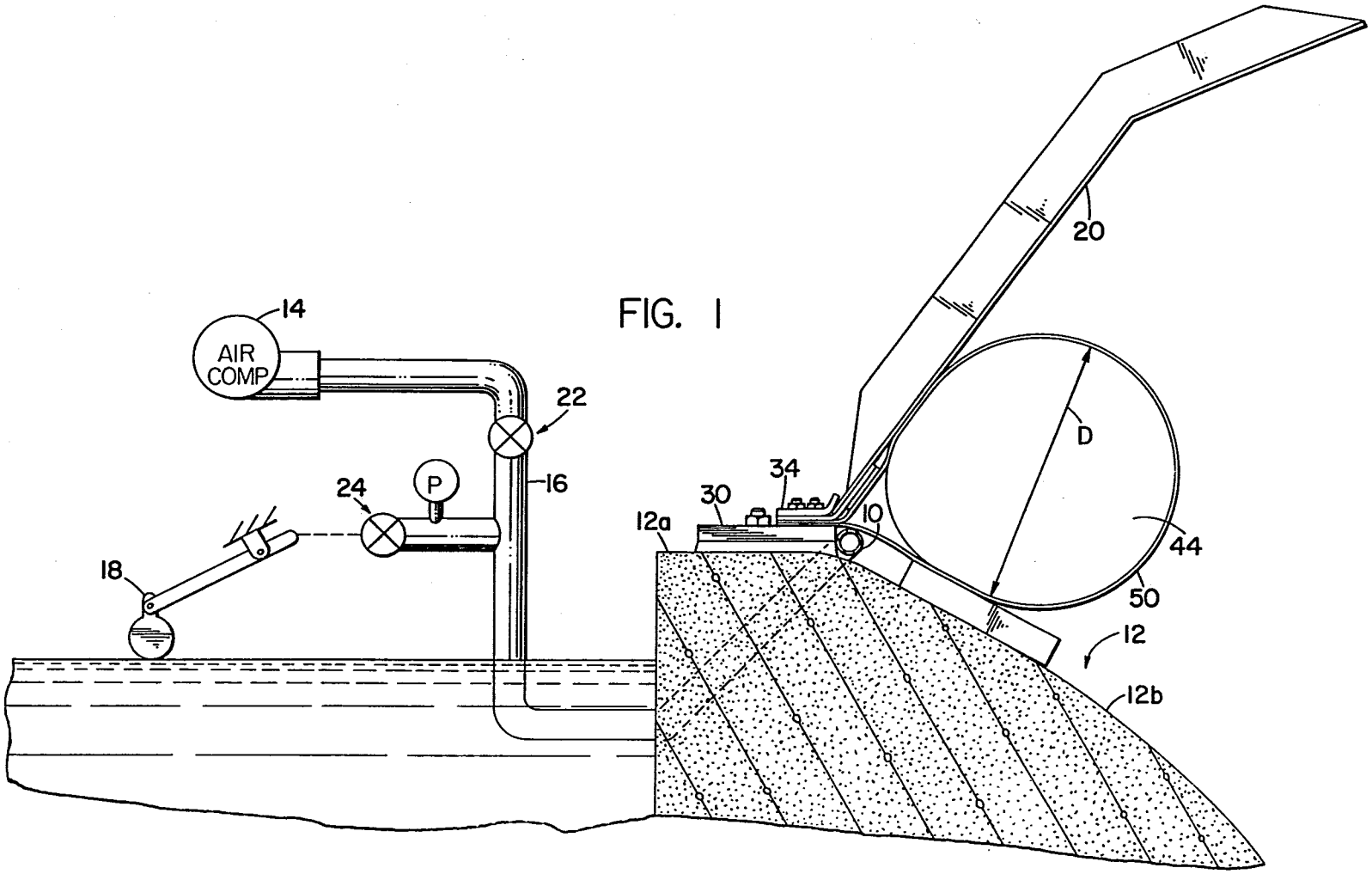
FIG. 1 is a vertical section showing in schematic fashion the various components of a preferred form for the present invention.

Turning now to the drawings in greater detail, FIG. 1 shows the essential elements of the present invention as including a means for supplying fluid under pressure to a manifold line 10 adjacent a dam structure 12 that is to be equipped with a crest gate in accordance with the present invention. The means for supplying pressure preferably includes an air compressor 14 and associated supply pipe 16 for providing air at a predetermined pressure to the manifold 10. In one form the invention includes a water level detection device, as indicated at 18, for regulating the pressure in supply pipe 16 to activiate the crest gate and raise the plurality of side by side panels 20, 20 in accordance with certain predetermined parameters such as the height of the water level behind the dam 12. A supply valve 22 may be provided in the line 16 with the valve 24 being coupled to the water level detection device 18 so as to provide for exhausting air from the conduit 16 and manifold 10 when the water level drops below a predetermined level.

Figure 2:
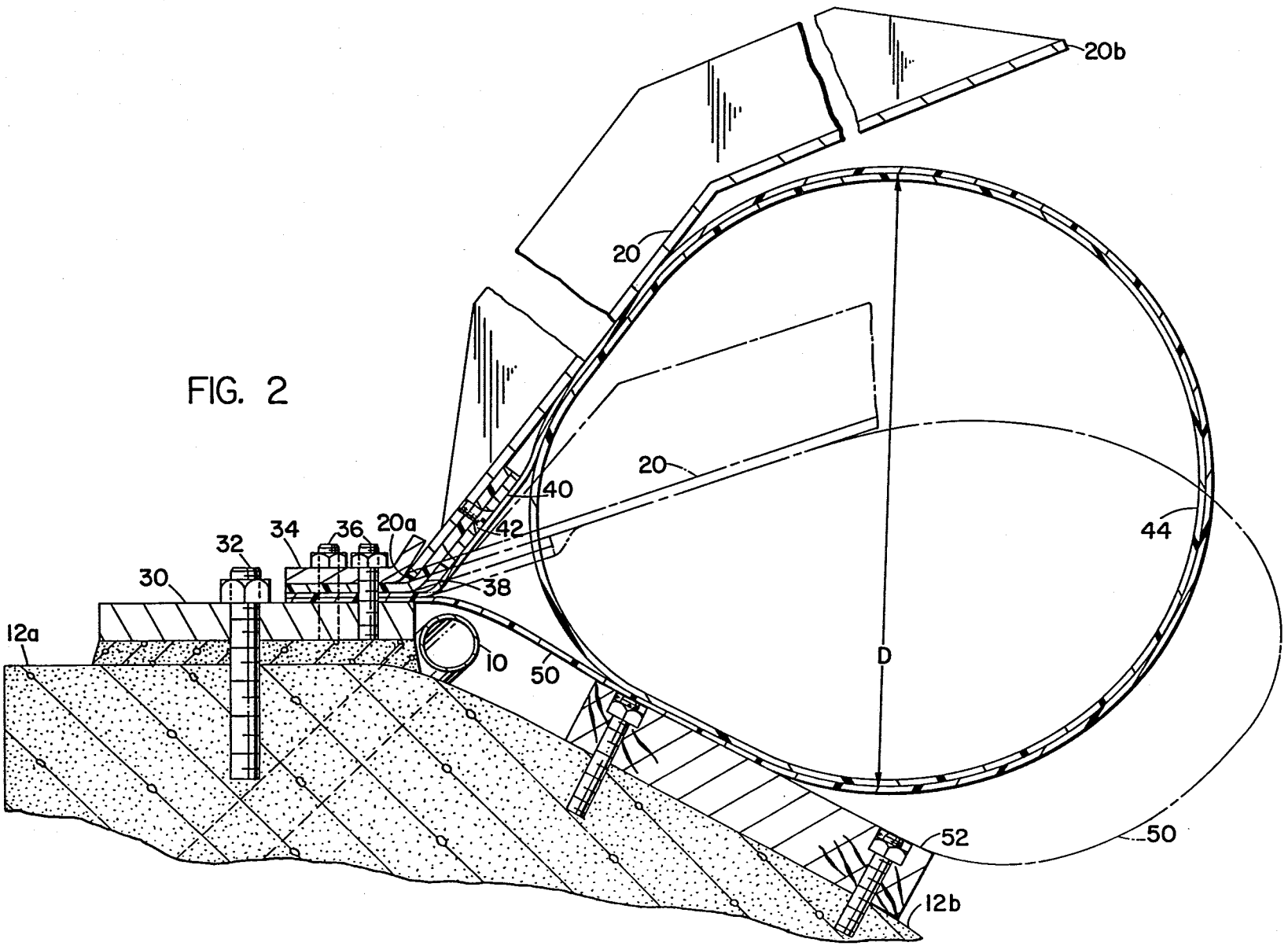
FIG. 2 is a detailed vertical section through the hinge joint and support for the harness, and illustrates the bladder in its inflated condition in full lines, the bladder and panel structure being illustrated in an intermediate postion in broken lines.

The present invention relates particularly to the structure for the crest gate itself, and FIG. 2 illustrates the crest gate construction in greater detail. Means is provided for pivotably supporting the panels 20, 20 for movement between angularly spaced positions on an axis located adjacent the dam spillway 12*a*. FIG. 2 shows a panel 20 in its raised position in solid lines and in a lowered intermediate position in broken lines, the axis of movement for the panel being provided at or adjacent a lower marginal edge 20*a* of said panel so that an opposite or free marginal edge 20*b* is movable vertically between raised and lowered position. Although an automated system is shown for controlling the crest gate it will be apparent that the gate could also be controlled manually.

Figure 3:
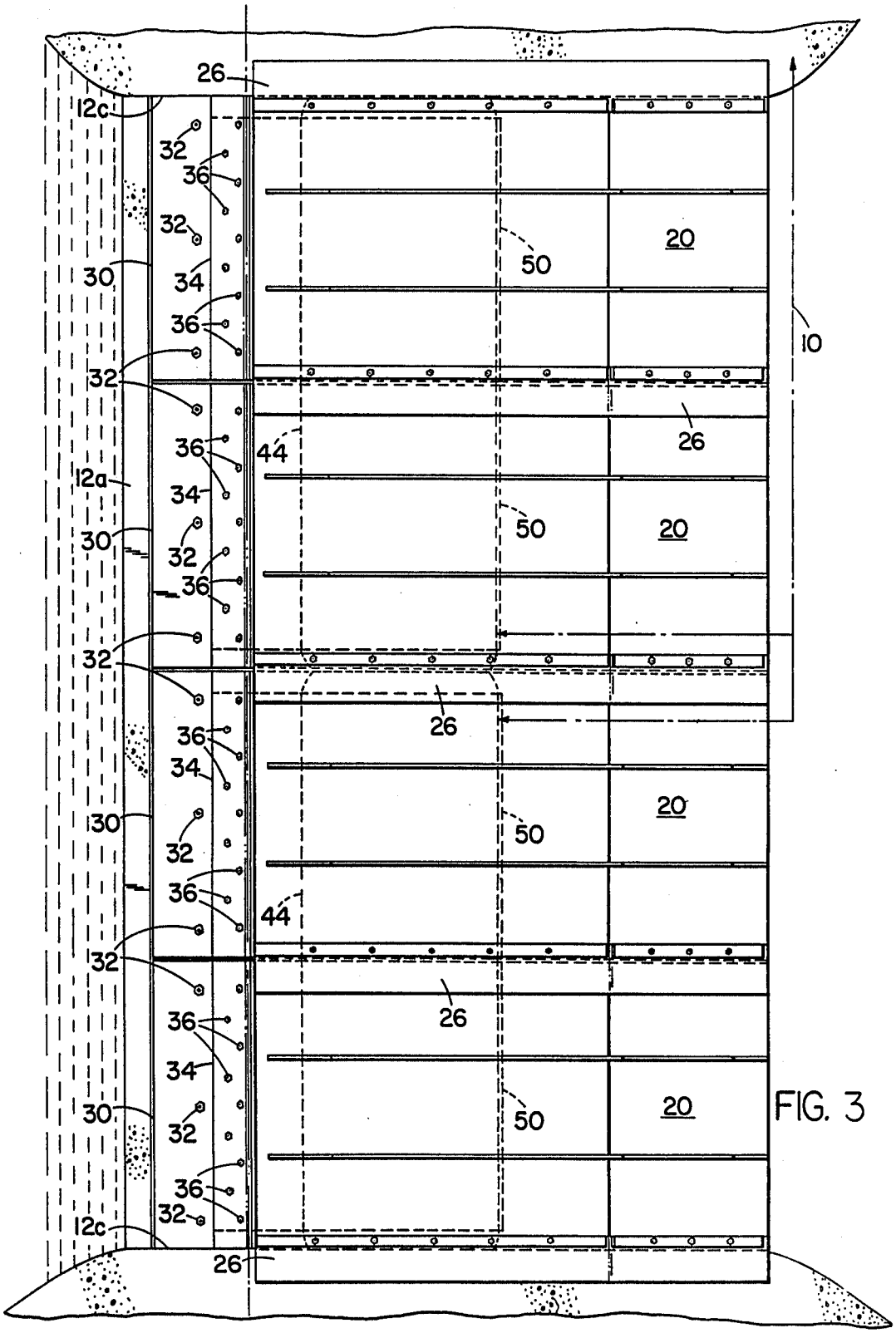
FIG. 3 is a top plan view of a crest gate incorporating four panels in combination with two bladders and associated harness means.

The crest gate includes several side by side panels as suggested in FIG. 3 and each panel preferably includes a relatively heavy elastomeric sealing member 26 provided adjacent at least one edge of the panel to provide a seal between the panels and to thereby hold back water when the panels are in their raised positions. Each panel 20 is generally rectangular and includes an upper edge portion that is angled downwardly as suggested in FIG. 2, and each panel preferably includes longitudinally spaced vertical stiffeners, also as shown in FIG. 2, in order that the overall weight of each of the panels 20 be kept to a minimum without sacrificing the structural integrity of the panel as it is subjected to static and dynamic water pressure. The crest gate panels are designed to spill water over the free edge 20*b* and the configuration for the panel is adapted to protect the underlying bladder structure and its associated harness from debris flowing over these panels 20.

Turning next to a detailed description for pivotably supporting these panels. FIG. 2 shows such means as including a relatively heavy structural steel member 30 which is anchored to the dam spillway by anchor bolts 32. This member 30 is preferably in the form of a generally rectangular bar to which is attached an elongated clamp bar 34 by means of clamping screws 36 threadably received in the bar 30 as shown. The clamping bar 34 serves to anchor one marginal edge of an elastomeric hinge member 38, which member 38 is flexible and deformable so as to provide a non-corrosive hinge joint for the panels 20,20 as they move from their raised positions shown through the intermediate position illustrated in broken lines to a lower most position where the panel 20 actually rests on the downwardly sloped ramp portion 12*b* of the dam spillway. The hinge member 38 is preferably manufactured from a nylon reinforced neoprene, and is clamped between the bar 30 and the clamp member 34 along one marginal edge and the opposite or free marginal edge of the hinge member 38 is secured to the lower marginal edge portion of the gates 20,20. An elongated bar 40 is preferrably screwed to the panel 20 by screws 42 as shown in FIG. 2.

Figure 2A:
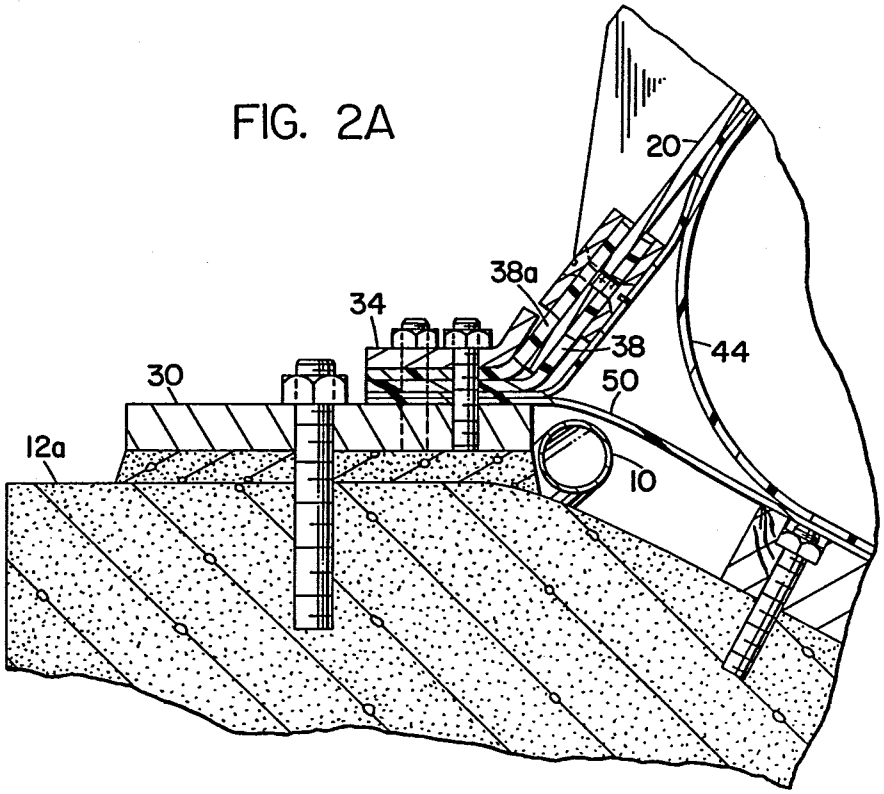
FIG. 2A is a view of an alternative hinge joint.

FIG. 2A shows an alternative construction for the hinge joint of FIG. 2, and is especially well suited for lowering the crest gate panels beyond the horizontal and to provide a lowered position such that the panel 20 is located on the spillway structure itself. The concave shape of the panel underside is such that this can be done while having sufficient space for the bladder and harness. As shown in FIG. 2A a second elastomeric strap hinge 38*a* is preferably provided on top of panel 20. This configuration will prevent the lower pivoted edge of the panel from slipping out from under the upturned edge of the clamping member 34.

Turning next to the mechanism for raising and lowering the crest gate panels 20, 20 and for pivoting same on the axis defined by the flexible hinge 38, said means preferably comprises elongated inflatable bladder means in the form of tubular members closed at their opposite ends and including at least one air inlet means that communicates with the manifold 10. Said bladder means preferably includes several individual tubular members as suggested in FIG. 3 and one such elongated tubular bladder may actually support two side by side panels 20, 20. As shown in the FIG. 3 construction two such bladders support four panels in a configuration that permits the manifold 10 to extend only half way across the opening defined by the dam abutments 12*c*. These bladders are fabricated from a suitable elastomeric material such as Hypolon for example.

Each of the bladders 44 is held in position by a harness fabricated of nylon reinforced neoprene and comprising a generally rectangular strip wrapped around each bladder 44 and clamped between the bar 30 and clamping member 34 by the screws 36 described previously. This construction not only serves to support the bladder 44 in proper relationship to the panel 20 and more particularly the pivot axis defined at its lower edge 20*a*, but this configuration for the bladder support harness also serves to protect the pressurized bladder against damage as a result of engagement between the panel 20 and the harness 50. As the panel 20 rubs against the harness 50 the pressurized bladder 44 provided inside the harness does not come in direct contact with the panel but is protected from it thereby increasing the life of the bladder in the hostile environment of the dam spillway.

The harness also serves to protect the bladder 44 from engagement with the ramp surface 12*b* of the dam spillway and in the preferred construction shown a plank 52 is provided on the spillway ramp 12*b* to be engaged by the harness 50 in order that the bladder 44 be further protected against damage and to protect the harness 50 as well. This plank 52 need not extend completely across the spillway, and may be omitted entirely if the spillway is constructed with a constraint contour along its entire length. In lieu of the plank 52 shims can be used to provide a linearly true reaction surface for the bladder and harness. As so constructed and arranged the bladder 44 serves to provide a convenient mechanism for raising and lowering the crest gate panels 20, 20 with inflation of the bladder being conveniently accomplished from a manifold 10 provided in a protected position below the axis of movement for the panel as defined by its marginal edge 20*a*. The bladder 44 has an inflated diameter D which need only be a fraction of the lateral extent for the panel 20. More particularly, in a preferred embodiment of the present invention a typical bladder may be ten feet in length and only sixteen inches in diameter D. With such a bladder supported as suggested in FIG. 2 a panel 20 of nearly 48 inches in lateral extent as measured from its pivot axis to its free edge 20*b* can be conveniently supported and raised or lowered as required with air pressure provided from manifold 10. In a crest gate construction equipped with bladders of this geometry and supporting panels of this size and shape a relatively inexpensive mechanism is provided for raising and lowering the panels. One or more inflatable bladders are provided adjacent the axis of movement for the panels with each bladder fully protected in the down position for the crest gate panels in that the panels will completely cover the deflated bladders. More importantly, when the bladder is inflated to raise the panel to the positions shown in FIG. 2 the bladder is still relatively protected not only from debris carried downstream by the water behind the crest gate, but the bladder is also protected from debris flowing over the top of the crest gate at high water level conditions. The size and shape for the bladders assures that the mechanism for raising and lowering these panels will be protected to the maximum extent possible not only from damage due to upstream water and debris flowing over the crest gate, but also due to vandalism or extraneous forces to which a typical crest gate may be subjected in the field. The geometry of providing a tublar bladder of diameter D, and a panel of lateral extent of approximately three times D, has been found to provide maximum protection for the bladder, and to afford the necessary degree of dynamic force for raising the crest gate panels against the force of the water.

We claim:

1. A crest plate for a dam spillway comprising a horizontally extending member adapted to be secured to the spillway, a least on rectangular panel, means pivotably supporting said panel for movement between angularly spaced positions on an axis adjacent said horizontally extending member, said axis located adjacent one marginal edge of said panel and said panel having an opposite marginal free edge movable vertically between a down and an up position, elongated inflatable bladder means of generally cylindrical cross section when inflated, harness means for supporting and protecting said elongated bladder means in relationship to said panel; and means for inflating said bladder to engage and to move said panel and thereby raise said marginal free edge thereof, said means pivotably supporting said panel comprising an elongated strip of elastomeric material having one marginal edge portion secured to said horizontally extending member and having an opposite marginal edge portion secured to said panel adjacent said one panel marginal edge.

2. The apparatus of claim 1 wherein said bladder means has an inflated diameter D, and wherein said panel has a lateral dimension between said one and said opposite marginal edge of at least twice D, said dimensional relationship providing protection for said bladder means particularly when deflated and when said panel free edge is down.

3. The apparatus of claim 1 wherein said bladder means has an inflated diameter D, and wherein said panel has a lateral dimension between said one and said opposite marginal edge of approximately three times D, said panel opposite free edge when up providing said panel at an angle to the horizontal of at least approximately 45 degrees to protect said bladder from debris carried over said panel free edge.

4. The apparatus of claim 1 wherein said elastomeric strip is secured to the panel on the same side of the panel as that engaged by said inflatable means, and an elongated clamp bar for securing said strip to said horizontally extending member, said clamp bar having an upturned lip along one marginal edge and said panel one marginal edge provided between said elastomeric strip in said lip.

5. The apparatus of claim 4 wherein said bladder means has an inflated diameter D, and wherein said panel has a lateral dimension between said one and said opposite marginal edge of at least twice D, said dimensional relationship providing protection for said bladder means particularly when deflated and when said panel free edge is down.

6. The apparatus of claim 4 wherein said bladder means has an inflated diameter D, and wherein said panel has a lateral dimension between said one and said opposite marginal edge of approximately three times D, said panel opposite free edge when up providing said panel at an angle to the horizontal of at least approximately 45 degrees to protect said bladder from debris carried over said panel free edge.

7. The apparatus of claim 6, wherein said harness means comprises a resilient rectangular sling having both marignal edges clamped by said clamping bar, said sling having an intermediate portion passed around said bladder means for so supporting said bladder means.

8. The apparatus of claim 7 wherein said means for inflating said bladder means comprises a manifold line oriented parallel said panel pivot axis and spaced below said sling, and lines connecting said manifold to said bladder means.

9. The apparatus of claim 8 wherein a plurality of panels are supported by said inflatable bladder means, each said panel having a water seal at one end to close the space between adjacent panels.

* * * * *